United States Patent [19]

Barthelemy et al.

[11] Patent Number: 4,912,362

[45] Date of Patent: Mar. 27, 1990

[54] STURDY OXIDE CATHODE FOR CATHODE RAY TUBE

[75] Inventors: Jean-Pierre Barthelemy, Eybens; Christine Uberto, Grenoble, both of France

[73] Assignee: Thomson-CSF, Paris, France

[21] Appl. No.: 254,693

[22] Filed: Oct. 7, 1988

[30] Foreign Application Priority Data

Oct. 9, 1987 [FR] France ..... 87 13960

[51] Int. Cl.[4] ..... H01J 1/26; H01J 9/04

[52] U.S. Cl. ..... 313/270; 313/337; 445/51

[58] Field of Search ..... 313/270, 337, 340, 346 R; 445/46, 35, 50, 51

[56] References Cited

U.S. PATENT DOCUMENTS

| | | | |
|---|---|---|---|
| 3,005,926 | 10/1961 | Horner et al. | 313/337 |
| 3,495,121 | 2/1970 | Katz | 313/337 |
| 3,821,589 | 6/1974 | Katz et al. | 313/346 R |
| 4,611,145 | 9/1986 | Kamuf et al. | 313/446 |

FOREIGN PATENT DOCUMENTS

| | | |
|---|---|---|
| 2120339 | 7/1978 | France . |
| 2373866 | 7/1978 | France . |

*Primary Examiner*—Kenneth Wieder

*Attorney, Agent, or Firm*—Oblon, Spivak, McClelland, Maier & Neustadt

[57] ABSTRACT

In thermoemissive cathodes for cathode ray tubes, in particular filament heated barium-calcium-strontium oxide cathodes, to give sturdiness to the filament and its alumina sheath in the presence of vibrations which might damage this sheath, it has been the practice to use an insulated reinforcing strip, soldered to the cathode tube, which restricts the movement of the filament during vibration. This method entails high manufacturing costs for mediocre results. The invention proposes to use a cathode, comprising a tube made of refractory metal closed by a refractory plug. The tube is filled with an alumina powder which is sintered before covering the plug with a standard emitting capsule of active nickel coated with metal oxides. The sintered alumina powder provides high cohesion between the filament and the inner wall of the tube. Excellent resistance to vibrations is obtained.

5 Claims, 1 Drawing Sheet

STURDY OXIDE CATHODE FOR CATHODE RAY TUBE

BACKGROUND OF THE INVENTION

1. Field of the Invention

The invention concerns cathode ray tubes and, more precisely, the making of the cathode of these tubes.

2. Description of the Prior Art

The cathode is that element of the tube which enables the emission of an electron beam towards the display screen of the tube.

To produce this emission of electrons, the cathode has, in its front part pointed towards the screen, a substance chosen for its capacity to emit a high density of electrons when it is raised to a sufficient temperature and when it is subjected to a strong electrical field.

The active substance is most usually heated by an electrically resistive filament (a wound tungsten filament) placed inside a sleeve, one end of which carries the active electron emitting substance. Herein, we shall be concerned only with filament heated cathodes although there are also so-called directly heated cathodes having no filament.

Depending on the applications envisaged (in particular, depending on whether a greater or smaller electrical emission density is desired) two types of cathodes are commonly used.

The first type of cathode is called the "impregnated cathode". It is made in the following way: the active electron emitting element, placed in the front of the cathode, is a chip made of porous, sintered tungsten, the pores of which are filled with barium-calcium aluminate. It is this substance that forms the emissive material. Emission takes place as a result of the chemical reaction between tungsten and aluminate, and this reaction produces free barium. Since the extraction potential of barium electron towards the vacuum is low, the emission of electrons becomes possible. However, this chemical reaction occurs only at a very high temperature of about 1100° C., so that the filament which will be used to produce this temperature should itself be carried to an even greater temperature. These impregnated cathodes are very valuable because they can be used to give very high electron emitting density without any acceleration of ageing owing to this high density, but they are very costly because of the technological constraint imposed by the very high temperature of the filament and because of difficulties in manufacturing (machining, impregnating, etc.) the active chips of impregnated tungsten.

The second type of commonly used cathode is called the "oxide cathode". The active emitting element herein is a capsule of active nickel (nickel with the addition of a small percentage of tungsten and traces of magnesium) coated, on its front side pointed to the screen, with a layer of barium, calcium and strontium oxides. The heating filament is contained in a nickel tube enclosed by the capsule of active nickel. The temperature of the nickel capsule should reach about 800° C. so that the reactions needed for electronic emission occur. These reactions are, firstly, an oxidation-reduction of the barium, calcium and strontium oxides by the active nickel and, secondly, an electrolysis of the oxides layer to release barium. The advantage of these cathodes is their lower working temperature, whence their lower manufacturing cost, but their main drawback as compared with impregnated cathodes, is their far lower emitting density if it is desired that they should have a sufficient lifetime.

The present invention concerns solely oxide cathodes for applications in which the electron emission density does not need to be very high and for which, consequently, there would be no justification for the high cost of an impregnated cathode. The standard constitution of a prior art oxide cathode is shown in the sectional view in FIG. 1.

It has a metallic tube 10 or cathode tube containing the heating filament 12 (shown uncut). The tube is open at its rear end (on the side opposite to the electron transmission) to let through the ends 14 and 16 of the filament which should be connected to a voltage source.

The front end of the cathode tube 10 is enclosed by a capsule 18 of active nickel (nickel with the addition, for example, of 4% of tungsten and 0.05% of magnesium). This capsule fits on to the top of the tube, and its internal diameter is equal to the external diameter of the tube in such a way that the tube is hermetically sealed at its front end. The capsule is electrically spot-soldered all around its periphery.

A layer 10 of barium/calcium/strontium oxides is deposited on the external front surface of the capsule 18 of active nickel, namely on that portion of the tube-closing capsule which is outside the tube.

The cathode tube 10 is mounted on a disk-shaped insulating support 22, used to center the cathode tube in the cathode ray tube for which the cathode is the emitting element. The fixing of the tube 10 is done through a thermal shield 24, made of a nickel-chromium alloy for example, which concentrically surrounds the tube 10 without touching it in its hottest part (namely in the central part and front end of the tube 10) and which is soldered to the tube in its rear part towards the ends of the filament.

The thermal shield 24 is crimped onto the insulating support 22. Its function is to avoid heat losses from the cathode tube 10. It is not in contact with the cathode tube, except at one end, and besides the contact occurs only at some points, the cylindrical thermal shield being pinched in a triangular form to its rear end, so that it can be soldered at three spots to the rear part of the cathode tube. There is therefore little transmission of heat by conduction between the cathode tube 10 and the supporting element. Furthermore, the thermal shield is reflective to prevent heat losses by radiation. Finally, it will be noted that the wall of the cathode tube 10 is very thin, here again to prevent heat losses by thermal conduction.

The heating filament 12 is a tungsten wire or tungsten alloy wire in a double helix winding as can be seen in FIG. 1. Sometimes, this coil is made not on a single, linear wire of tungsten but on a wire which is already in a helix winding with small-diameter turns, in order to increase the length of the wire.

The tungsten wire is not a bare wire, but a wire coated with a fine alumina layer (not seen in FIG. 1) so that the turns are electrically insulated from one another and from the cathode.

We have thus described the structure of a prior art oxide cathode.

The essential problem faced is the strength of the filament under severe environmental conditions, and especially in the presence of vibrations. The alumina sheath which coats the tungsten wire should be very pure and have no cracks to prevent breakdown and leakage currents, especially when the ends of the filament are carried to a potential which is very different from that of the cathode (in this respect, technical specifications often require the cathode to operate faultlessly, even when the cathode-filament potential difference reaches 200 volts).

When there are vibrations, the alumina sheath cracks and the risks of breakdown and leakages inside the cathode tubes are heightened. Furthermore, the wearing down of the alumina sheath produces particles which are propagated outside the cathode tube and penetrate the chamber of the cathode ray tube itself. The very high voltages (15 to 40 kilovolts) present in this chamber cause the breakdown of the cathode ray tube when foreign particles move about in the highly intense electrical fields that prevail between the anode and the cathode. Even if the cathode ray tube does not break down, the particles get deposited on the display screen, which is carried to very high voltage, and cause black spots thereon, spoiling the quality of the image.

To boost the mechanical strength of the filament, it has already been proposed to introduce, in the axis of the wound filament, a reinforcing strip soldered to the cathode tube. This strip is coated with alumina so that it remains electrically insulted from the filament. Then it is inserted within the tungsten wire coil. This insertion is a delicate task because it should not damage the fine alumina sheath of the reinforcing strip. Then the filament mounted on the strip is covered with alumina. Then the strip is electrically soldered to the cathode tube at its rear end. The strip is preferably U-shaped (like a hairpin). During operation, through it rigidity which is greater than that of the wound filament, it restricts the movements of the latter, and hence limits the wearing down of the sheath of the tungsten wire.

This type of cathode with a reinforced filament has the following drawbacks:

- high cost (5 to 10 times the cost of an ordinary filament) because of additional assembly operations;
- difficulty of assembly in the cathode because the reinforcing strip of the cathode tube must be soldered without damaging the alumina sheath;
- average and undependable sturdiness;
- the positioning of the filament with respect to the closed end of the cathode tube is difficult and non-reproducible because the filament cannot be pushed completely up to the back of the tube (as could be done with a non-reinforced filament). For, subsequent expansions, during operation, of the reinforcing strip have to be taken into account.

On this latter point (difficulty of positioning) it should be clearly understood not only that the temperature of the cathode is lower if the filament is not completely pushed in but, above all, that if the filament is not always placed strictly in the same position in a mass-produced batch of cathodes, the result will be variation in the cathode temperature reached during operation, hence variation in transmission characteristics. These variations are not acceptable.

SUMMARY OF THE INVENTION

To avoid the disadvantages of prior art oxide cathodes as far as possible, the present invention proposes a new emissive cathode structure for cathode ray tubes, the cathode being of the type that has a thin cathode tube, closed at one front end by a cylindrical capsule made of active nickel, the external surface of the capsule being coated, in its part transversal to the axis of the tube, with a layer based on metallic oxides, the cathode tube enclosing a heating filament, made of refractory metal such as tungsten, coated with a refractory insulating material such as alumina. According to the invention, the cathode tube is made of refractory metal, and a closing plug, made of a refractory metal which is a good heat conductor, is placed at the front end of the tube, a part of the plug being inside the tube and the other part extending outside, the active nickel capsule, coated with oxides, being soldered at its edge to the external wall of the tube, facing the plug, with a sintered refractory insulating substance filling the gaps between the filament and the wall of the tub and making the filament solidly joined to the internal wall of the tube; the sintered refractory substance being preferably the same as the one that coats the filament, notably alumina.

The manufacturing method according to the invention comprises the following steps:

- the preparation of a cathode tube made of refractory metal;
- the positioning of a plug, made of a refractory metal which is a good heat conductor, at the end which will become the front end of the tube, and the soldering of this plug to the inner wall of the tube, in letting a part of the plug extend beyond the front end of the tube;
- the coating of a heating filament with a refractory insulating material;
- then the positioning of the filament inside the plugged tube;
- the introduction in the tube of a suspension of refractory insulating powder, preferably the same as the one coating the filament;
- the evaporation of the suspension solvent;
- the sintering, at high temperature, of the insulating refractory powder to provide mechanical cohesion between the filament and the internal wall of the tube through the sintered powder;
- the positioning of an active nickel capsule on the refractory metal plug;
- and the soldering of this capsule to the wall of the tube at the front end of said tube facing the plug.

BRIEF DESCRIPTION OF THE DRAWING

Other features and advantages of the invention will appear from the following detailed description, made with reference to the appended drawing, of which.

DESCRIPTION OF A PREFERRED EMBODIMENT

Figure 1:
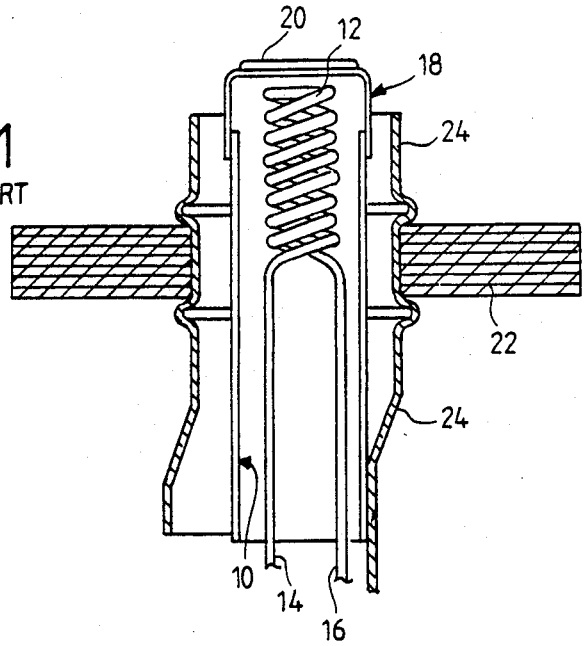
FIG 1 PRIOR ART
FIG. 1 already described represents the prior art embodiment of oxide cathodes.
Figure 2:
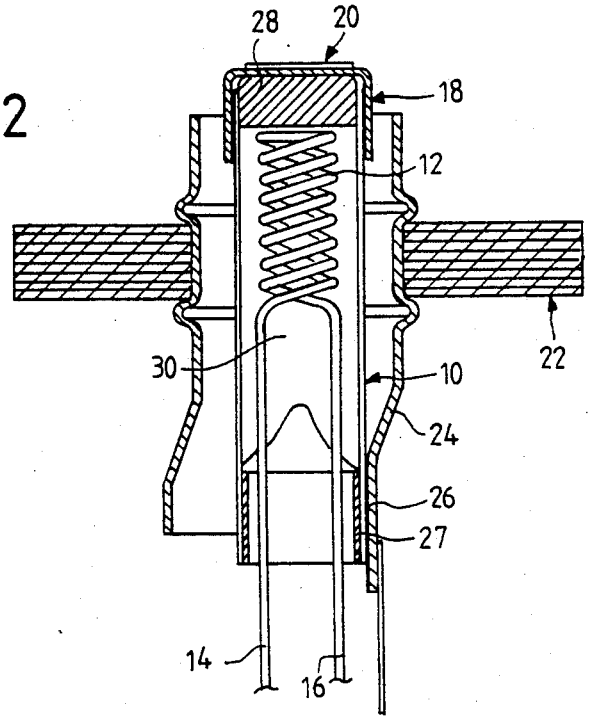
FIG. 2 shows an embodiment of an oxide cathode according to the invention.

In FIG. 2, the same references are used designate elements corresponding to those of FIG. 1. More precisely these are: the cathode tube 10 (which is now made of refractory metal, preferably molybdenum, and no longer of nickel or nickel alloy); the heating filament 12 which is still preferably a tungsten wire coated with a thin coating of refractory insulating material (preferably alumina) which cannot be seen in the figures; the ends 14 and 16 of the filament, which go out by the rear part of the tube; the active nickel capsule 18, placed at the front end of the tube 10 and bearing, on its font face, a layer 20 of metal oxides (preferably a layer of barium-calcium-strontium oxides); the disk-shaped insulating support 22 to center the cathode tube in the cathode ray tube; and the thermal shield 24, concentrically surrounding the hottest part of the cathode tube and pinched into a triangle at its rear to be spot soldered to the cathode tube. The thermal shield is crimped on to the insulating disk 22.

FIG. 2 shows, for example, a soldering spot 26 between the thermal shield 24 and the tube 10. Since the wall of the tube 10 is preferably very thin (less than one tenth of a millimeter) to avoid heat losses by conduction, there is provided, preferably, a tube reinforcing washer 27 placed inside the tube in the region of the soldering zone 26. For, the tube is held in place only by these soldering spots and the risk of breakage in the wall of the tube around the soldering spots is high.

According to the invention, apart from the fact that the tube 10 is now made of refractory metal, there is provided a plug 28, made of a refractory metal which is a good conductor of heat, at the front end of the tube, interposed between this end and the active nickel capsule 18. The material forming the plug is preferably the same as that of the tube, i.e. it is preferably molybdenum.

As can be seen in FIG. 2, the plug 28 extends partially into the tube 10 and partially outside it. In other words, it penetrates the tube, but goes slightly beyond it. Its external diameter is adjusted to that of the inner wall of the tube so as to hermetically close the tube at its front end, and it is fixed to the tube, by an electrical soldering operation, all around the external wall of the tube.

The active nickel capsule 18, which is cylindrical, has a wall which is transversal to the axis of the tube and a cylindrical lateral wall surrounding the front end of the cathode tube 10. This cylindrical wall is electrically soldered to the wall of the tube, all around it. The plug 28 acts as a support during this soldering operation for it is seen to it that the soldering is done at the place where the lateral wall of the capsule faces the lateral wall of the plug.

When the capsule is being positioned and soldered, it is seen to it that the internal part of its transversal face is closely applied to the corresponding face of the plug 28 (which, it may be recalled, extends outside the tube 10).

Finally, the heating filament, which is preferably a tungsten wire coated with a thin alumina coat, in a helix winding, is embedded in a sintered refractory substance 30 (preferably also alumina) which is electrically insulating and is a good conductor of heat. After the sintering operation, this substance provides high mechanical cohesion between the filament and the internal wall of the tube.

The method for manufacturing this cathode should take into account the fact that an operation for sintering the refractory material has to be performed and that this sintering operation, which takes place at very high temperature, is incompatible with the presence of the nickel of the capsule 18. The manufacturing operations therefore take place in such a way, that the sintering can be done before the capsule 18 is positioned.

The manufacturing is begun by making a very thin cathode tube of refractor material, either by drawing a thicker tube or by rolling a thin metal foil and electrically soldering superimposed edges of the rolled foil.

Then, the front end of the tube is closed by a plug of refractory metal, the diameter of which is adjusted to the internal diameter of the tube. The plug is allowed to go slightly beyond the end of the tube and the tube and the plug are electrically spot soldered all round the front end of the tube.

A reinforcing washer (the washer 27 in FIG. 2) is placed at the rear end of the tube and electrically soldered to it.

In the meantime, a heating filament is made. This filament is a helix wound linear tungsten wire, or a tungsten wire, already wound in small-diameter turns, which is then wound in a single or double helix winding (FIG. 2 shows a linear wire in a double helix winding). This wire is coated with a refractory insulating sheath (alumina) deposited by spraying, as in painting, or by electrophoresis (deposition in the presence of a strong electrical field, in a liquid dielectrical medium containing alumina particles treated to be charged).

The filament coated with alumina is placed inside the cathode tube plugged at its front end.

The cavity thus formed by this plugged tube is filled with a suspension of very fine alumina powder. The suspension consists, for example, of a mixture of alumina powder and an organic solvent.

The solvent is allowed to evaporate preferably in open air and at ordinary temperature if the nature of the solvent allows it. The evaporation preferably takes place while the tube is subjected to a rotational motion which homogenizes the distribution of the powder all around the interior wall of the tube, between the filament and this wall. Preferably, the rotation takes place on an axis tilted with respect to the horizontal, the axis of the tube being kept parallel to this tilted axis.

Then the alumina is sintered by carrying the entire cathode tube, with the filament and the alumina, to a temperature of about 1700° C. The alumina powder gets agglomerated and gains high cohesion. Furthermore, it gets strongly bound to the tungsten filament and the inner wall of the tube (preferably made of molybdenum). The filament, then, is solidly joined to the cathode tube and withstands vibrations particularly well. Its positioning at the back of the tube does not raise any special problems, and the reproducibility of this positioning is very high.

The active nickel capsule is then positioned on the front end of the tube. The contact between this capsule and the molybdenum plug should be very close to provide the most efficient heat transmission possible from the filament to the nickel capsule. The periphery of the capsule is electrically soldered all around the cathode tube, facing the plug so that the lateral wall of the plug acts as a support preventing deformations in the (very thin) tube during the soldering process.

The cathode tube is inserted within a cylinder forming a thermal shield (shield 24 in FIG. 2). The shield with a cylindrical section is pinched at its rear part so that it comes into contact at three spots with the rear end of the tube at the reinforcing washer 27, and an electrical soldering operation is performed at these spots to join the tube solidly to the shield.

Finally, an insulating disk, drilled with a central aperture (disk 22 in FIG. 1), is fitted around the thermal shield 24 and the shield is crimped onto this disk.

The barium-strontium-calcium oxides layer is deposited on the active nickel capsule by spraying, either before the capsule is positioned on the tube or, preferably, after this operation. Preferably it is positioned after all the above-described operations.

What is claimed is:

1. An emissive cathode structure for cathode ray tubes, the cathode being of the type having a thin cathode tube, close at one front end by a cylindrical capsule made of active nickel, the external surface of the capsule being coated, in its part transversal to the axis of the tube, with a layer based on metallic oxides, the cathode tube enclosing a heating filament, made of refractory metal, coated with a refractory insulating material, wherein the cathode tube is made of refractory metal, and a closing plug, made of a refractory metal which is a good heat conductor, is placed at the front end of the tube, a part of the plug being inside the tube and the other part extending outside it, the active nickel capsule, coated with oxides, being soldered at its edge to the external wall of the tube, facing the plug, with a sintered, refractory, electrically insulating and heat conducting substance filling the gaps between the filament and the wall of the tube and making the filament solidly joined to the internal wall of the tube.

2. A cathode structure according to claim 1, wherein the refractory metal of the tube and that of the plug consist of molybdenum.

3. A cathode structure according to either of the claims 1 or 2, wherein the substance filling the tube is a sintered alumina powder.

4. A cathode structure according to either of the claims 1 or 2, wherein the rear part of the cathode tube is reinforced by a washer in order to facilitate the soldering of the rear part of the tube to a supporting element.

5. A method for manufacturing a metallic oxide emissive cathode, comprising the following steps:

(a) preparation of a cathode tube made of refractory metal;

(b) positioning of a plug, made of a refractory metal which is a good heat conductor, at the end which will become the front end of the tube, and soldering of said plug to the inner wall of the tube, letting a part of the plug extend beyond the front end of the tube;

(c) coating of a heating filament with a refractory insulating material;

(d) then the positioning of the filament inside the plugged tube;

(e) the introduction in the tube of a colloidal suspension of refractory insulating powder, (f) evaporation of the suspension liquid;

(g) sintering, at high temperature, of the refractory insulating powder to provide mechanical cohesion between the filament and the internal wall of the tube by means of the sintered powder;

(h) positioning of an active nickel capsule on the refractory metal plug;

(i) and soldering of said capsule to the wall of the tube at the front end of said tube facing the plug.

* * * * *